US009095182B1

(12) United States Patent
Rochholz

(10) Patent No.: US 9,095,182 B1
(45) Date of Patent: Aug. 4, 2015

(54) ANTI-CHAFING CHIN STRAP ACCESSORY

(76) Inventor: Robert S. Rochholz, Coupeville, WA (US)

( * ) Notice: Subject to any disclaimer, the term of this patent is extended or adjusted under 35 U.S.C. 154(b) by 993 days.

(21) Appl. No.: 12/978,236

(22) Filed: Dec. 23, 2010

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/04
USPC ..... 2/421, 425, 209.13, 460, 422; 224/264
See application file for complete search history.

(56) References Cited

U.S. PATENT DOCUMENTS

| | | | | | |
|---|---|---|---|---|---|
| 1,262,818 | A | * | 4/1918 | McGill | 2/421 |
| 2,643,380 | A | * | 6/1953 | Blair | 2/460 |
| 2,867,811 | A | * | 1/1959 | Jones | 2/421 |
| 4,706,305 | A | * | 11/1987 | Cho | 2/425 |
| 4,884,301 | A | * | 12/1989 | Aileo | 2/421 |
| 5,109,803 | A | * | 5/1992 | Dunham et al. | 119/654 |
| 5,287,559 | A | | 2/1994 | Christiansen et al. | |
| 5,315,714 | A | * | 5/1994 | Peters et al. | 2/181.4 |
| 5,428,844 | A | * | 7/1995 | Dougherty | 2/209.13 |
| 5,499,402 | A | * | 3/1996 | Rose | 2/209.13 |
| 5,500,951 | A | * | 3/1996 | Marchello | 2/455 |
| 5,546,605 | A | * | 8/1996 | Mallardi | 2/209.13 |
| 5,595,332 | A | * | 1/1997 | Freedman | 224/264 |
| 5,737,777 | A | * | 4/1998 | Hilleary | 2/421 |
| 5,794,274 | A | * | 8/1998 | Kraemer | 2/421 |
| 5,826,281 | A | | 10/1998 | Rush | |
| 6,006,362 | A | * | 12/1999 | Walsh | 2/209.13 |
| 6,282,725 | B1 | * | 9/2001 | Vanidestine, Jr. | 2/421 |
| 6,298,483 | B1 | | 10/2001 | Schiebl et al. | |
| 6,481,024 | B1 | * | 11/2002 | Grant | 2/421 |
| 7,003,812 | B1 | * | 2/2006 | Lewis et al. | 2/468 |
| 7,219,374 | B2 | * | 5/2007 | Cho | 2/181 |
| 7,886,370 | B2 | * | 2/2011 | Winningham | 2/421 |
| 8,291,520 | B2 | * | 10/2012 | Lukens | 2/423 |
| 2007/0083986 | A1 | * | 4/2007 | Kaiser | 2/410 |
| 2010/0071118 | A1 | | 3/2010 | Tobey | |
| 2011/0296595 | A1 | * | 12/2011 | Lukens | 2/423 |
| 2014/0123369 | A1 | * | 5/2014 | Chapman | 2/311 |

FOREIGN PATENT DOCUMENTS

| | | |
|---|---|---|
| CA | 2698158 | 3/2009 |
| GB | 2455112 | 11/2009 |

* cited by examiner

*Primary Examiner* — Danny Worrell
(74) *Attorney, Agent, or Firm* — Michael I. Kroll

(57) ABSTRACT

A strap cover as a tubular sleeve formed of a laminated bilayer material having an elastomeric inner layer and a non-abrasive outer layer. The laminated bilayer material is affixed along opposite edges to form the laminated bilayer material into a tubular sleeve having a longitudinal seam formed by the affixed opposite edges.

9 Claims, 9 Drawing Sheets

ANTI-CHAFING CHIN STRAP ACCESSORY

BACKGROUND OF THE INVENTION

1. Field of the Invention

The present invention relates generally to head gear and, more specifically, to an accessory device for increasing the comfort of chin straps or support elements associated with helmets or safety headgear by means of providing a strap cover formed as a sheath of soft non-abrasive material to cover the straps or supporting elements so that when contacting a user's face chafing does not occur.

The present invention provides a sleeve having longitudinal edges that are sewn forming a tube-like structure for inserting a strap therethrough.

The strap cover additionally provides for a wrap having mating fastening means positioned along opposing longitudinal sides, further providing a first fabric layer with a soft ply and a second layer formed of an elastomeric material for drawing the soft layer against the user's skin.

The application illustrates a specific embodiment of the invention, which is not intended to limit the invention in any manner.

2. Description of the Prior Art

There are other head gear devices designed for comfort and preventing chafing of the face. Typical of these is U.S. Pat. No. 1,262,818 issued to McGill on Apr. 16, 1918.

Another patent was issued to Jones on Jan. 13, 1959 as U.S. Pat. No. 2,867,811. Yet another U.S. Pat. No. 4,884,301 was issued to Alleo on Dec. 5, 1989 and still yet another was issued on Feb. 22, 1994 to Christiansen et al. as U.S. Pat. No. 5,287,559.

Another patent was issued to Rush et al. on Oct. 27, 1998 as U.S. Pat. No. 5,826,281. Yet another U.S. Pat. No. 6,282,725 was issued to Vanidestine, Jr. on Sep. 4, 2001. Another was issued to Schiebl et al. on Oct. 9, 2001 as U.S. Pat. No. 6,298,483 and still yet another was issued on Nov. 19, 2002 to Grant as U.S. Pat. No. 6,481,024.

Another patent was issued to Lewis et al. on Feb. 28, 2006 as U.S. Pat. No. 7,003,812. U.S. Patent Application No. 2010/0071118 was published to Tobey on Mar. 25, 2010. Canadian Patent No. CA2698158 was issued to Field on Mar. 30, 2010 and British Patent No. GB2455112 issued on Mar. 6, 2009 to Burak.

U.S. Pat. No. 1,262,818

Inventor: W. McGill

Issued: Apr. 16, 1918

A protective device comprising a chin strap band and a chin-protector carried by and adjustable relatively to said chin-band.

U.S. Pat. No. 2,867,811

Inventor: R. T. Jones

Issued: Jan. 13, 1959

The process of manufacturing a chin strap for use with a football helmet or the like, which comprises providing an elongated woven flexible web slit longitudinally to provide divided sections of the web intermediate its ends, impregnating said web with a heat-curable resinous substance, forming a cup shaped member of a flexible fabric to accommodate the chin of the wearer, impregnating at least the peripheral section of said cup shaped member with heat curable resinous substance, partially curing the plastic material of said web and of said cup, inserting said cup between the divided sections of said web with its peripheral section in overlapping face to face contact with the divided sections of the web, and with the undivided sections thereof immediately adjacent the divided sections, the heating and thus formed assemblage to complete the curing of the resinous substance to form a flexible cured composition and to bond said cup and web together.

U.S. Pat. No. 4,884,301

Inventor: Jackson A. Aileo

Issued: Dec. 5, 1989

A one-piece chinstrap-napestrap assembly for a helmet in which a pair of napestraps secured to the nape portion of the helmet interior at laterally spaced locations extend around the lower periphery of the helmet, crossing each other, and pass outwardly through slots formed in the front of the helmet to receive the ends of an adjustable chinstrap. Adjustment of the chinstrap at the front of the assembly produces a simultaneous adjustment of the crossing napestrap portions at the rear of the assembly without the necessity for independent adjustment of the latter strap portions. A padded napestrap retainer secured by straps to the same locations on the nape portion of the helmet is formed with intersecting passages for receiving the crossing strap portions. The retainer reduces chafing and urges the crossing napestrap portions toward the rear of the helmet when the chinstrap is released to facilitate donning and doffing.

U.S. Pat. No. 5,287,559

Inventor: David M. Christiansen et al.

Issued: Feb. 22, 1994

A fabric-covered foam rubber pad that is in a semicircular shape with a small slot gap in the center of the foam rubber pad that provides a hinge to allow it to easily fold in half and provide room for the sizing strap of a baseball-style cap. Hook-and-loop fasteners are attached to one side of the structure so that when placed up, under, and over a baseball-style cap's sizing strap it can be folded in half and secured in place.

U.S. Pat. No. 5,826,281

Inventor: Gus A. Rush

Issued: Oct. 27, 1998

A protective chin strap for headwear such as an athletic helmet is provided with a chin portion including an inflatable pouch and a manually operated valve pump so that the wearer can inflate the pouch to adjust the tension of the strap to adjust the force holding the helmet on the head of the wearer as well as at the same time provide a shock absorbing cushion on the chin of the user.

U.S. Pat. No. 6,282,725

Inventor: Thomas J. Vanidestine

Issued: Sep. 4, 2001

A protective, sanitary, and decorative athletic helmet chin strap cover is disclosed wherein an elastic sleeve fits over a conventional athletic helmet chin strap, contouring therewith and elastically securing thereto. The cover displays a team name or logo via embroidering, silk screening, or other fabric marking methods.

U.S. Pat. No. 6,298,483

Inventor: Paul Schiebl et al.

Issued: Oct. 9, 2001

Protective headgear comprises a rigid shell with face pads which may be released and removed while the headgear is still on a person's head. A protective chin guard may be attached to the headgear by way of the face pads. The chin guard comprises a substantially rigid shell with a removeable insert made of a flexible bladder filled with a shock absorbing fluid. The headgear may comprise a shell made of an inner and outer material layered over an internal foam core to effect both strength and lightweight.

U.S. Pat. No. 6,481,024

Inventor: Stephen P. Grant

Issued: Nov. 19, 2002

A protective chin strap device for use in securing a helmet to a wearer's head. The chin strap includes a hard outer shell, an inner member made of a self-supporting cushioned material and straps attached to the outer shell for securing the chin strap to a helmet. The inner member is secured with respect to the outer shell so as to contact the outer shell adjacent the wearer's chin yet form at least one cavity between the outer shell and inner member. This combination of elements serve to deflect impact forces applied to the chin strap and further serve to absorb and laterally dissipate those impact forces. The chin strap is comfortable to wear because the wearer's chin is cushioned by the inner member, because a soft liner is provided adjacent the wearer's skin to wick perspiration and moisture from the wearer's chin and because the chin strap is ventilated.

U.S. Pat. No. 7,003,812

Inventor: Patricia Lewis

Issued: Feb. 28, 2006

A protective garment having a collar has a chinstrap attached to the collar via an elongate member having two opposite ends, each of which is attached to the collar and one of which is attached detachably to the collar via a hook-and-loop fastener. The chinstrap is adjustable along the elongate member to any on a range of adjusted positions of the chinstrap along the elongate member. Preferably, the elongate member is a strap, which or at least a portion of which is elastic, and the chinstrap has a hem, through which the elongate member passes.

U.S. Patent Application Number US2010/0071118

Inventor: Karen B. Tobey

Published: Mar. 25, 2010

A cover for an eyewear strap is provided. The cover may include a first member, a second member associated with the first member and movable toward and away from the first member, and a fastener connected to the first member and the second member for removably connecting the first member to the second member. The cover may be adapted to receive an eyewear strap between the first and second members when the first and second members are disconnected, and the cover may be securable to the eyewear strap when the first and second members are connected together.

Canadian Patent Number CA2698158

Inventor: Josh Field

Issued: Mar. 30, 2009

A chinstrap assembly includes a chin protector coupled to protective headgear, such as a helmet, through a substantially inelastic strap member and a shock absorbing device. In the event of an impact on the protective headgear, a mechanical impulse is transferred from the headgear through the strap member and shock absorbing device to the chin protector. A maximum value of the mechanical impulse as received at the chin protector is moderated by the shock absorbing device.

U.K. Patent Number GB2455112

Inventor: Roy Burek

Issued: Nov. 28, 2009

A helmet strap arrangement comprising a front portion, passing under the wearers chin, and a rear portion, passing around the side and rear of the wearers head. The front and rear sections have ends which are secured to the helmet at separate locations, the rear attachment point may be spaced away from the rearmost point of the helmet. The rear section has a deformable or padded element located in a pocket, the pocket may be located adjacent to the end of the rear strap section which is attached to the helmet. The deformable element may be a pad which may have a concave side and a convex side, the concave side may face the wearer. The deformable means may be an elastomeric suction cup.

SUMMARY OF THE PRESENT INVENTION

A primary object of the present invention is to provide a means for covering the contacting surface of a chinstrap for headgear with a material that will prevent chafing of the face due to traditional strap to skin contact.

Another object of the present invention is to provide a means for providing the user of any headgear an accessory for covering said headgears associated chin strap to prevent chafing of one's face.

Yet another object of the present invention is to provide a sheath for head gear straps constructed of a non-dermatologically abrasive material such as felt.

An additional object of the present invention is to provide a strap cover comprising a planar fabric having longitudinal edges that are sewn forming a tube-like structure that can be slid onto a helmet strap.

Still yet another object of the present invention is to provide a comfortable sheath for head gear straps that can be opened longitudinally to cover and then refastened by means of hook and loop fasteners or other fastening means.

Additional objects of the present invention will appear as the description proceeds.

The present invention overcomes the shortcomings of the prior art by providing a covering for a chin strap or associated harnessing associated with a helmet or headgear, used to prevent chafing of skin against the straps by sheathing and covering them with a tubular soft non-abrasive material such as felt. Additionally the present invention provides for a wrap having mating fastening means positioned along opposing longitudinal sides, further providing a first layer and a second layer wherein the first layer is a fabric with a soft ply and the second layer is an elastomeric material.

The foregoing and other objects and advantages will appear from the description to follow. In the description reference is made to the accompanying drawing figures, which form a part hereof, and in which is shown by way of illustration specific embodiments by which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawings in which.

DESCRIPTION OF THE REFERENCED NUMERALS

Figure 1:
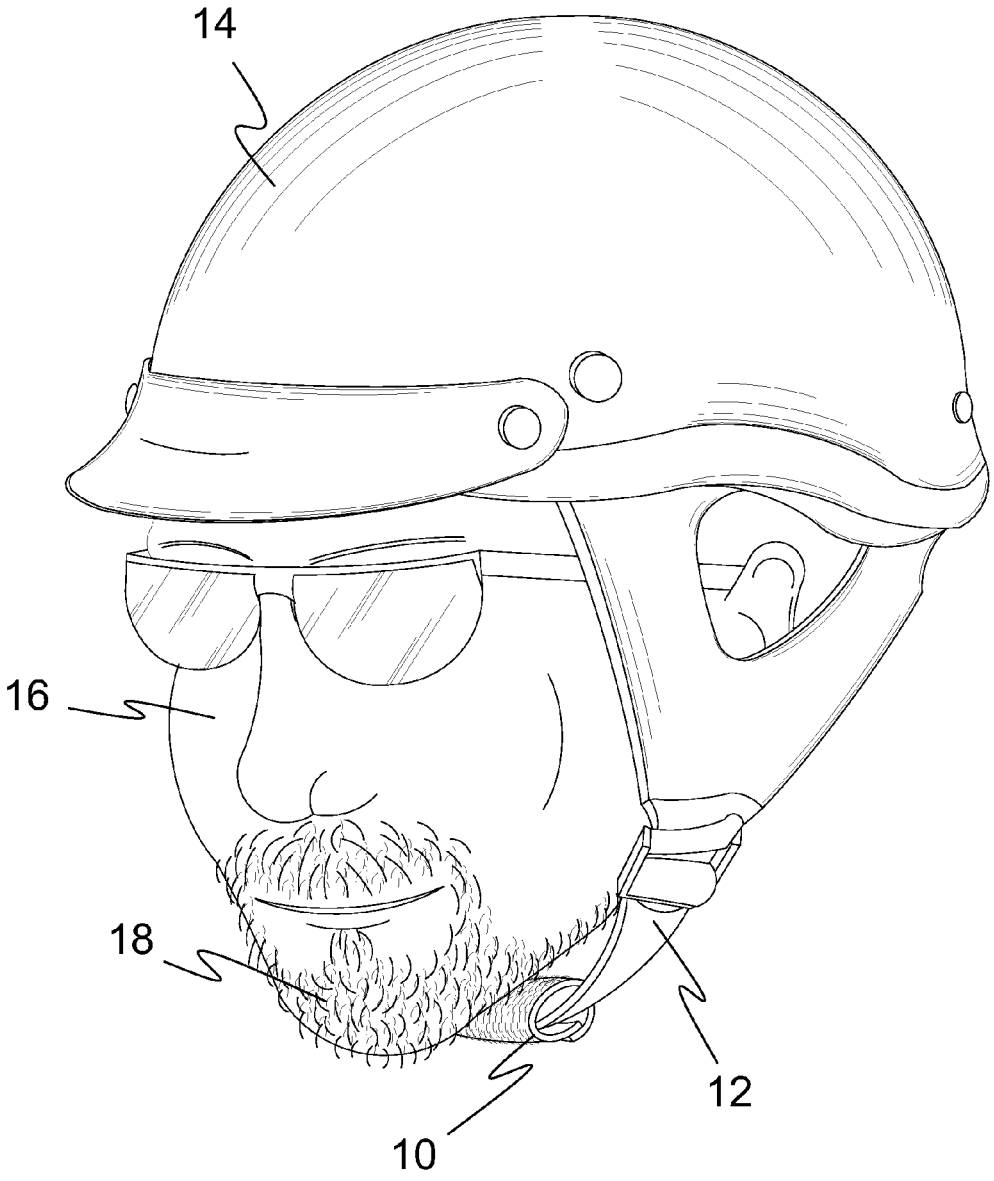
FIG. 1 is an illustrative view of the present invention in use.

Turning now descriptively to the drawing figures, in which similar reference characters denote similar elements throughout the several views, the figures illustrate the Strap Cover of the present invention. With regard to the reference numerals used, the following numbering is used throughout the various drawing figures.

10 Strap Cover of the present invention
12 strap
14 protective headgear
16 user
18 facial hair of 16
20 inner elastomeric layer of 10
22 outer layer of 10
24 male strap connector on 12
26 female strap connector 12
28 longitudinal seam in 10
30 fastening material along 28
32 pocket in 10
34 aperture in 32
36 disposable pad inertable into 32

DETAILED DESCRIPTION OF THE PREFERRED EMBODIMENT

The following discussion describes in detail one or more embodiments of the invention. This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the strap cover 10 of the present invention in use. The present invention is a facial-hair cushion/sleeve for a strap 12 such as a chinstrap for securing a helmet or other protective headgear 14 to the head of a user 16. The strap cover 10 of the present invention is particularly suited to providing comfort to a user 16 having facial hair 18, such as a beard.

Figure 2:
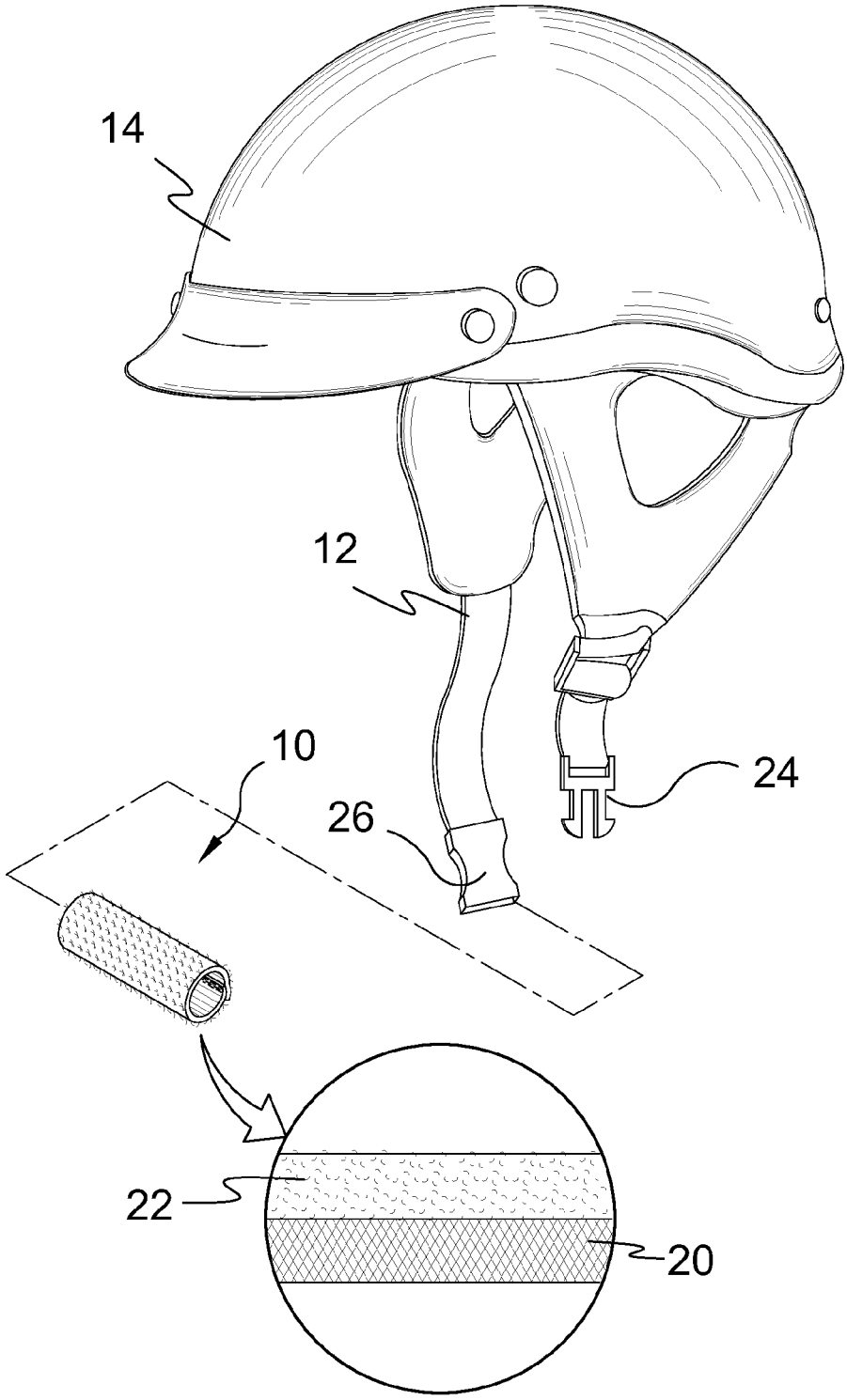
FIG. 2 is an illustrative exploded view of the present invention.

FIG. 2 is an illustrative exploded view of the detail of the strap cover 10 of the present invention. Shown is an embodiment of the invention being a generally tubular sleeve formed of a bilayer material having an elastomeric inner layer 20 and a non-abrasive outer layer 22. The outer layer 22 is a soft material such as a soft pile fabric to prevent facial hair from being entangled therein and to prevent skin chafing. The elastomeric inner layer 20 draws the soft pile of the outer layer 22 against the user's skin, and resiliently secures the strap cover 10 to the strap 12. Preferably, the elastomeric inner layer 20 and the soft outer layer 22 are laminated together and formed into a tubular sleeve, either permanently or removably. Shown is a typical strap 12 for protective headgear 14, the strap 12 having a two piece construction connectable, for example, by a male connector 24 and a mating female connector 26. When the strap cover 10 of the present invention is secured to a strap 12, it acts as a cushion between the strap 12 and/or the strap connectors 24, 26 and the user's skin and/or facial-hair, with the inner layer 20 causing the strap cover 10 to form-fit over the strap 12 and the connectors 24, 26.

Figure 3:
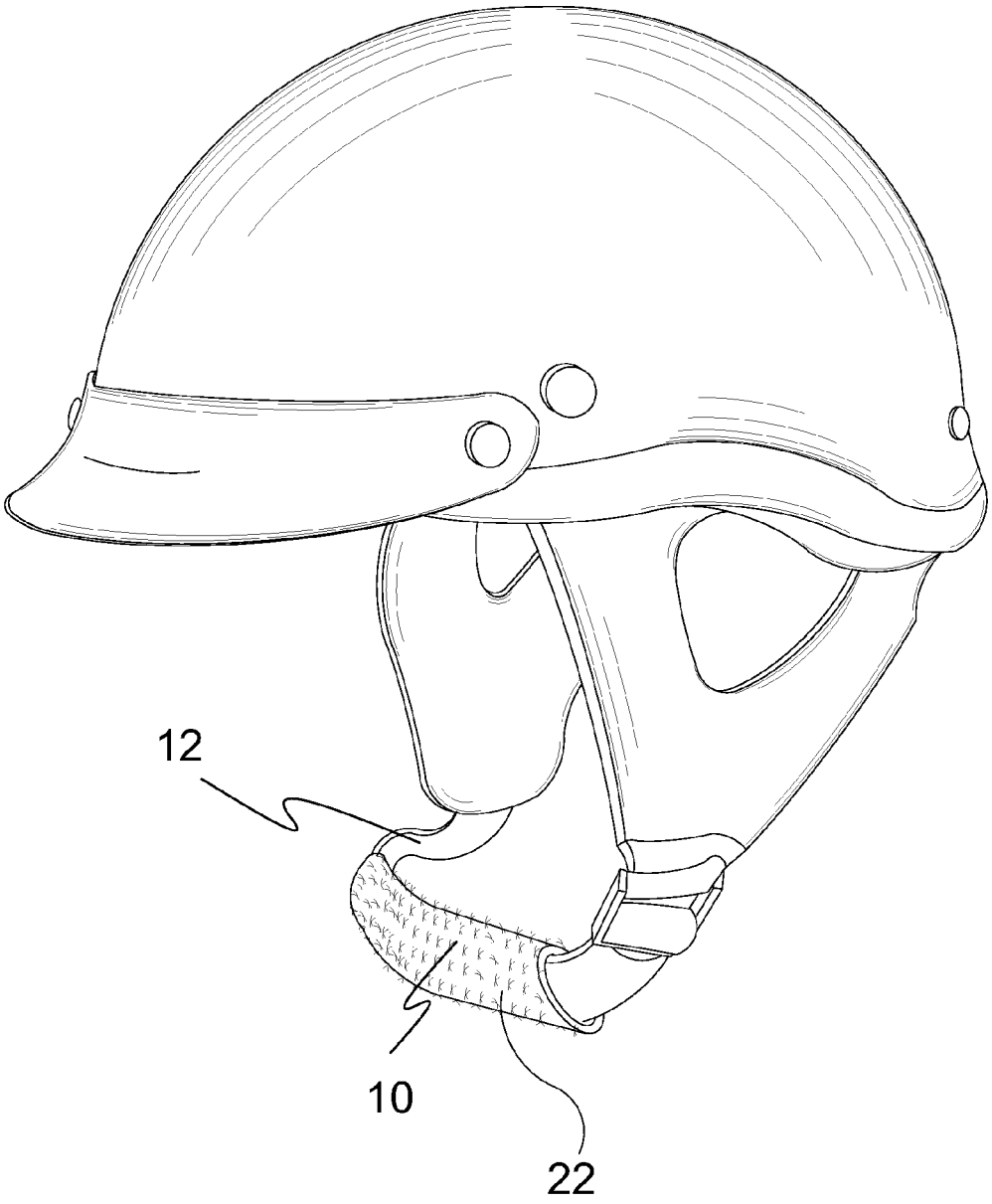
FIG. 3 is an illustrative assembly view of the present invention.

FIG. 3 is an illustrative assembly view of the strap cover 10 attached to a helmet's 14 chinstrap 12. Shown is the invention being a generally tubular sleeve with an outer layer 22 formed of a soft material such as a soft pile fabric to prevent facial hair from being entangled therein and to prevent skin chafing. Shown is the strap cover 10 secured over a strap 12 to act as a cushion between the strap 12 and the user's skin and/or facial-hair, with the strap cover 10 form-fitting over the strap 12.

Figure 4:
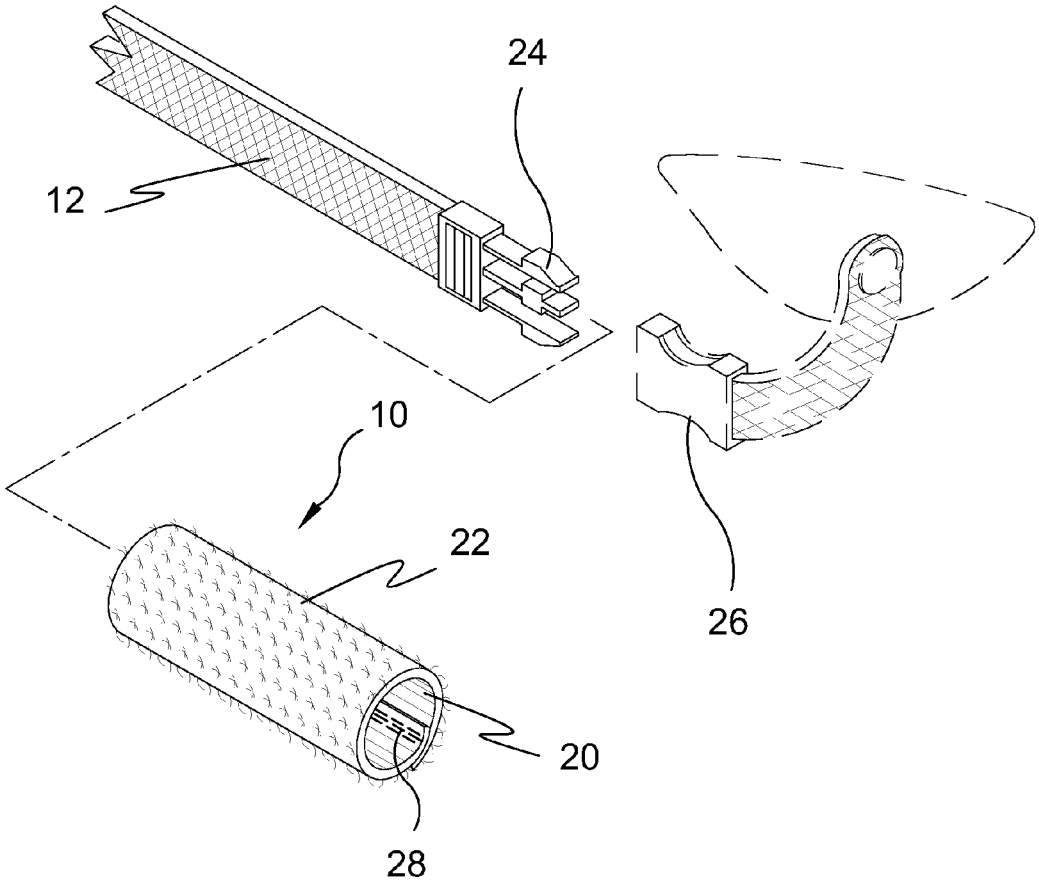
FIG. 4 is an exploded view of the present invention.

FIG. 4 is an exploded view of the strap cover 10 ready to be placed onto a generic helmet strap 12. Shown is an embodiment of the invention being a tubular sleeve formed of a generally planar material having longitudinal sides that are preferably sewn together to form the sleeve for receiving the helmet strap 12. The strap cover 10 is formed of a generally planar, bilayer material having an elastomeric inner layer 20 and a non-abrasive outer layer 22. The outer layer 22 is a soft material such as a soft pile fabric to prevent facial hair from being entangled therein and to prevent skin chafing. The elastomeric inner layer 20 draws the soft pile of the outer layer 22 against the user's skin, and resiliently secures the strap cover 10 to the strap 12. Preferably, the elastomeric inner layer 20 and the soft outer layer 22 are laminated together and formed into a tubular sleeve, for example by sewing, gluing or the like along a longitudinal seam 28 of the strap cover 10. Shown is a typical strap 12 for protective headgear 14, the strap 12 having a two piece construction connectable, for example, by a male connector 24 and a mating female connector 26. When the strap cover 10 of the present invention is secured to a strap 12, it acts as a cushion between the strap 12 and/or the strap connectors 24, 26 and the user's skin and/or facial-hair, with the inner layer 20 causing the strap cover 10 to form-fit over the strap 12 and the connectors 24, 26.

Figure 5:
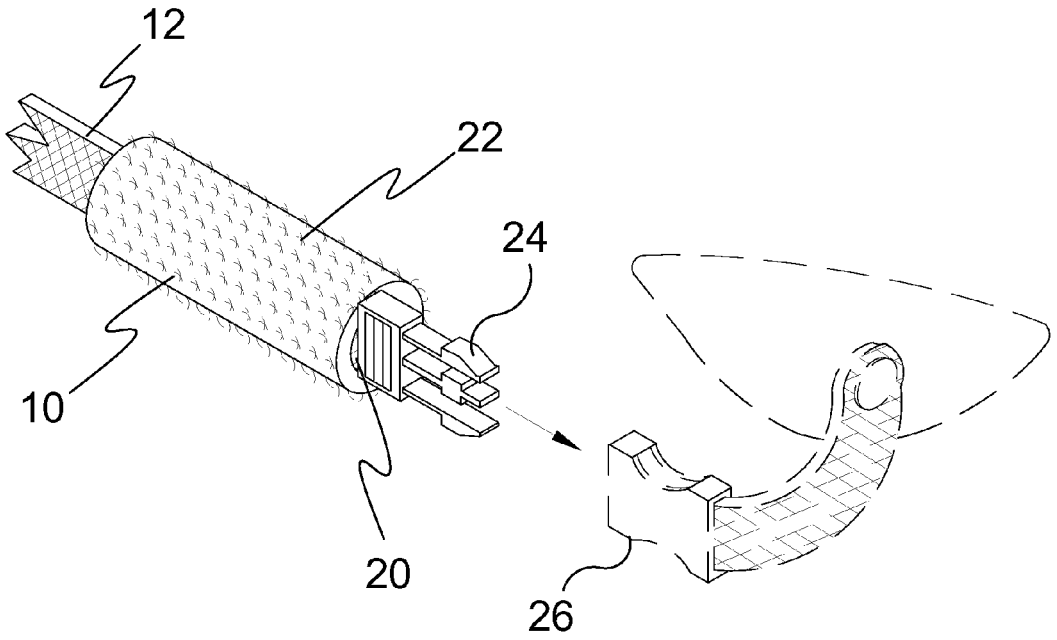
FIG. 5 is an assembled view of the present invention.

FIG. 5 is an assembled view of the strap cover 10 attached to a generic helmet strap 12. Shown is an embodiment of the invention being a tubular sleeve formed of a generally planar material having longitudinal sides that are preferably sewn together to form the sleeve for receiving the helmet strap 12. The strap cover 10 is formed of a generally planar, bilayer material having an elastomeric inner layer 20 and a non-abrasive outer layer 22. The outer layer 22 is a soft material such as a soft pile fabric to prevent facial hair from being entangled therein and to prevent skin chafing. The elastomeric inner layer 20 draws the soft pile of the outer layer 22 against the user's skin, and resiliently secures the strap cover 10 to the strap 12. Preferably, the elastomeric inner layer 20 and the soft outer layer 22 are laminated together and permanently formed into a tubular sleeve, for example by sewing, gluing or the like along a longitudinal seam 28 of the strap cover 10. Shown is a typical strap 12 for protective headgear 14, the strap 12 having a two piece construction connectable, for example, by a male connector 24 and a mating female connector 26. The strap cover 10 of the present invention is secured to a strap 12 by first sliding the strap cover 10 over either the male connector 24 or the female connector 26, connecting the male connector 24 to the female connector 26, then sliding the strap cover 10 over the connected male connector 24 and female connector 26 to act as a cushion between the strap 12 and the strap connectors 24, 26 and the user's skin and/or facial-hair, with the inner layer 20 causing the strap cover 10 to form-fit over the strap 12 and the connectors 24, 26.

Figure 6:
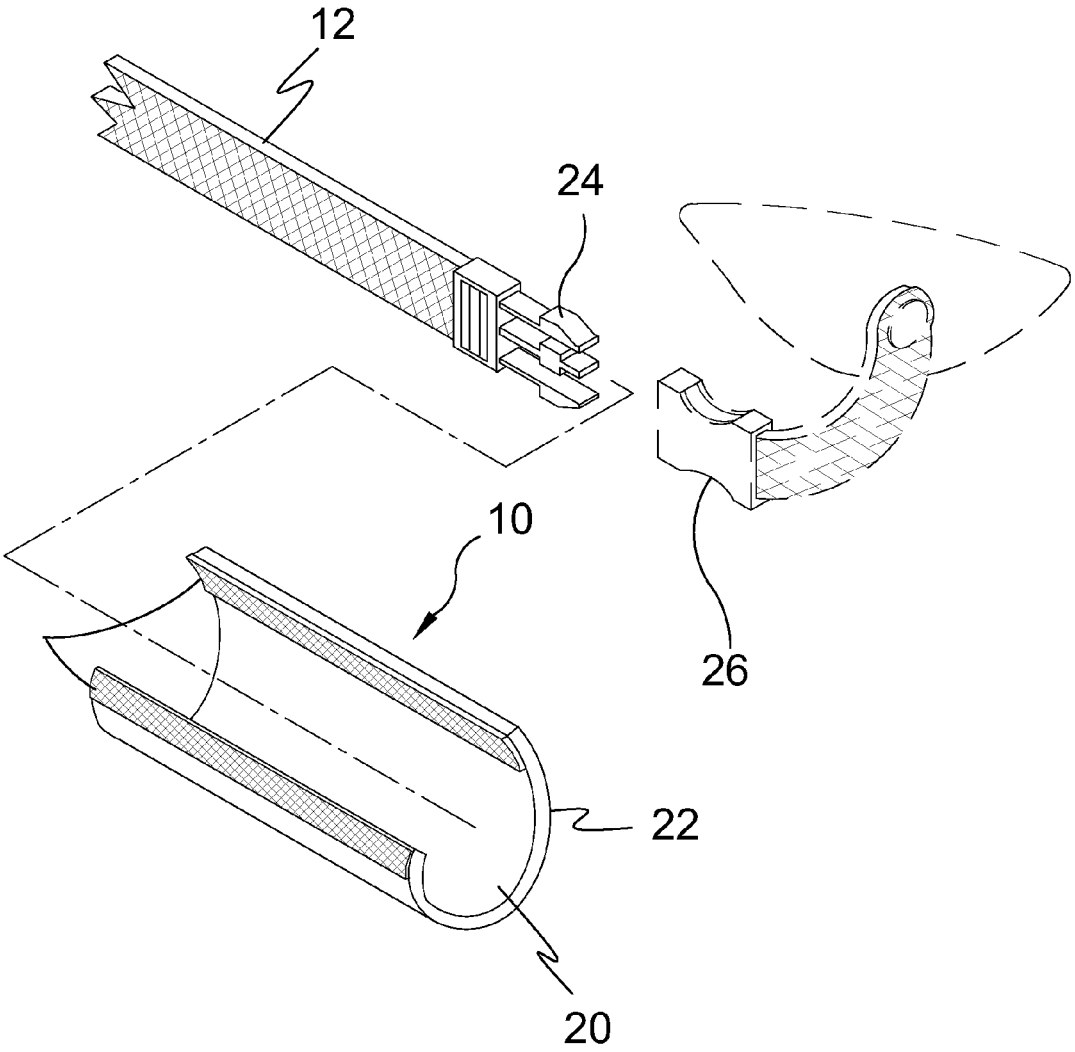
FIG. 6 is an alternate design of the present invention.

FIG. 6 is an alternate design of the strap cover 10 of the present invention. Shown is the strap cover 10 ready to be attached to a generic helmet strap 12. Shown is an embodiment of the invention being a tubular sleeve formed of a generally planar material having opposing longitudinal sides that are releasably fastened, for example, with hook and loop type fastening material 30, to form a longitudinal seam 28 in the tubular strap cover 10 for receiving the helmet strap 12. The strap cover 10 is formed of a generally planar, bilayer material having an elastomeric inner layer 20 and a non-abrasive outer layer 22. The outer layer 22 is a soft material such as a soft pile fabric to prevent facial hair from being entangled therein and to prevent skin chafing. The elastomeric inner layer 20 draws the soft pile of the outer layer 22 against the user's skin, and resiliently secures the strap cover 10 to the strap 12. Preferably, the elastomeric inner layer 20 and the soft outer layer 22 are laminated together and releasably formed into a tubular sleeve, for example by fastening material 30 such as hook and loop fasteners or the like along a longitudinal seam 28 of the strap cover 10. Shown is a typical strap 12 for protective headgear 14, the strap 12 having a two piece construction connectable, for example, by a male connector 24 and a mating female connector 26. The strap cover 10 of the present invention is secured to a strap 12 by first connecting the male connector 24 to the female connector 26, wrapping the unfastened strap cover 10 over the strap 12 and the connected male connector 24 and female connector 26, then fastening the fastening material 30 together to form a longitudinal seam 28 in the strap cover 10. The strap cover acts as a cushion between the strap 12 and the strap connectors 24, 26 and the user's skin and/or facial-hair, with the inner layer 20 causing the strap cover 10 to form-fit over the strap 12 and the connectors 24, 26.

Figure 7:
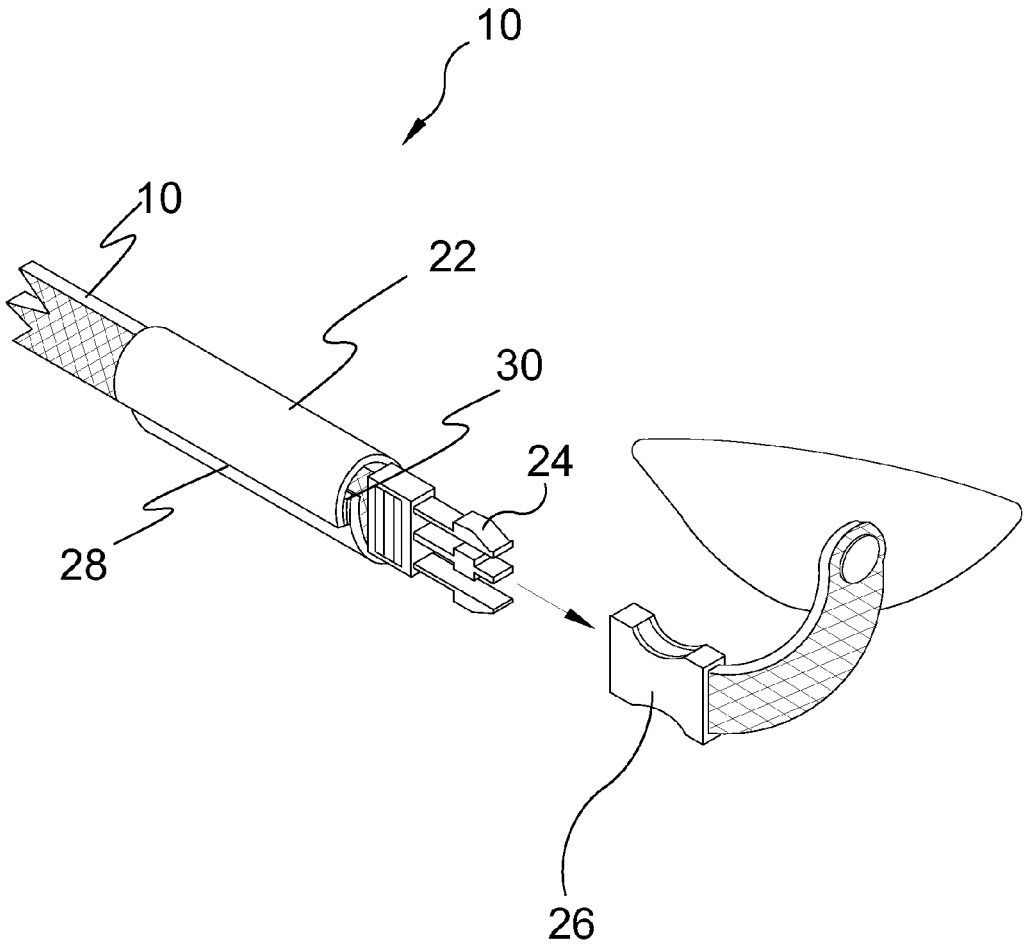
FIG. 7 is an alternate design of the present invention.

FIG. 7 is an alternate design of the facial-hair cushion of the present invention. Shown is the strap cover 10 attached to a generic helmet strap 12, an embodiment of the invention being a tubular sleeve formed of a generally planar material having opposing longitudinal sides that are releasably fastened to form a longitudinal seam 28 in the tubular strap cover 10 for receiving the helmet strap 12. The strap cover 10 is formed of a generally planar material having a non-abrasive outer layer 22 formed of a soft material such as a soft pile fabric to prevent facial hair from being entangled therein and to prevent skin chafing. Preferably, the strap cover 10 is releasably formed into a tubular sleeve along a longitudinal seam 28 of the strap cover 10. Shown is a typical strap 12 for protective headgear 14, the strap 12 having a two piece construction connectable, for example, by a male connector 24 and a mating female connector 26. The strap cover 10 of the present invention can be alternatively secured to a strap 12 by first wrapping the unfastened strap cover 10 over the strap 12, fastening the strap cover together to form a longitudinal seam 28 in the now tubular strap cover 10, connecting the male connector 24 to the female connector 26, then sliding the tubular strap cover 10 over the connected male connector 24 and female connector 26 such that it acts as a cushion between the strap 12 and the strap connectors 24, 26 and the user's skin and/or facial-hair.

Figure 8:
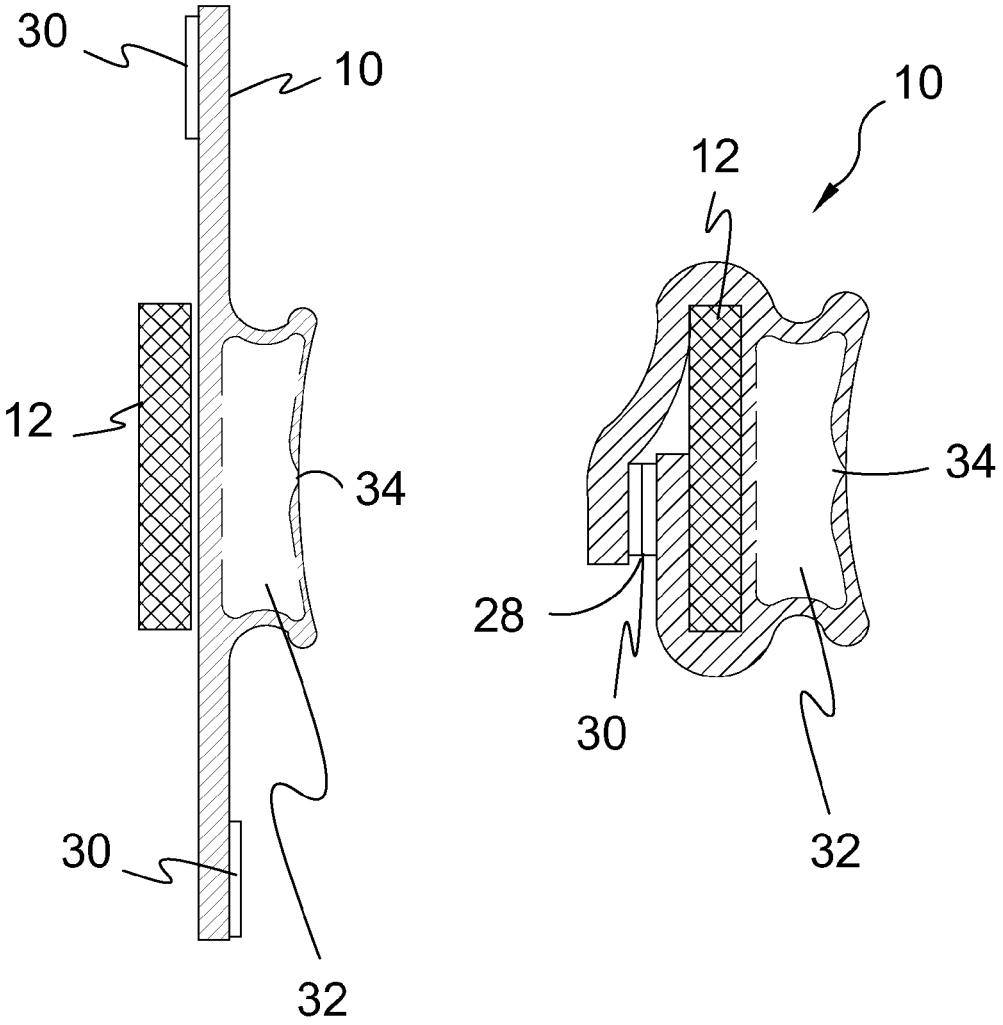
FIG. 8 is an alternate design of the present invention.

FIG. 8 is an alternate design of the strap cover 10 of the present invention. The strap cover 10 alternately includes a pocket 32 for receiving a soft cushion or warmer bag through an aperture 34 in an exterior surface of the pocket 32. Shown is the strap cover 10 before and after being attached to a generic helmet strap 12. Shown is an embodiment of the invention being a tubular sleeve formed of a generally planar material having opposing longitudinal sides that are releasably fastened, for example, with hook and loop type fastening material 30, to form a longitudinal seam 28 in the tubular strap cover 10 for receiving the helmet strap 12. The strap cover 10 is formed of a generally planar material releasably formed into a tubular sleeve, for example by fastening material 30 such as hook and loop fasteners or the like along a longitudinal seam 28 of the strap cover 10. The strap cover 10 of the present invention is secured to a strap 12 by wrapping the unfastened strap cover 10 around the strap 12, then fastening the fastening material 30 together to form a longitudinal seam 28 in the strap cover 10. The strap cover 10 acts as a cushion between the strap 12 and the user's skin and/or facial-hair, with the pocket 32 providing a receptacle for an insert providing additional cushioning or treatment for the user's contacting skin or hair.

Figure 9:
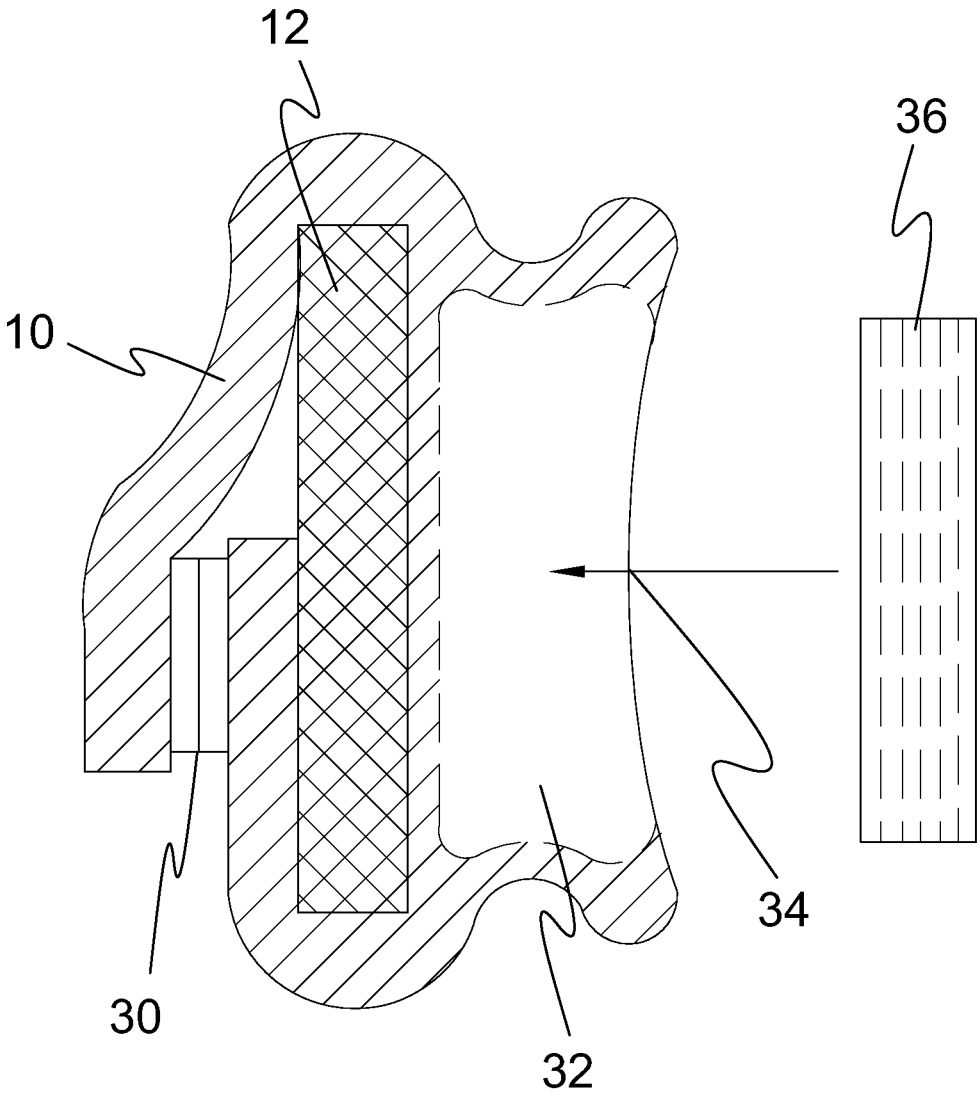
FIG. 9 is an alternate design of the present invention

FIG. 9 is an alternate embodiment of the strap cover 10 of the present invention. The strap cover 10 alternately includes a pocket 32 for receiving a receive a disposable pad 36, for example, for application of a conditioner or petroleum gel through an aperture 34 in the pocket 32, to prevent chafing of skin and entanglement of facial hair. Shown is the strap cover 10 attached to a generic helmet strap 12. Shown is an embodiment of the invention being a tubular sleeve formed of a generally planar material having opposing longitudinal sides that are releasably fastened, for example, with hook and loop type fastening material 30, to form a longitudinal seam 28 in the tubular strap cover 10 for receiving the helmet strap 12.

The strap cover 10 is formed of a generally planar material releasably formed into a tubular sleeve, for example by fastening material 30 such as hook and loop fasteners or the like along a longitudinal seam 28 of the strap cover 10. The strap cover 10 of the present invention is secured to a strap 12 by wrapping the unfastened strap cover 10 over the strap 12, then fastening the fastening material 30 together to form a longitudinal seam 28 in the strap cover 10. The strap cover 10 acts as a cushion between the strap 12 and the user's skin and/or facial-hair, with the pocket 32 providing additional cushioning or treatment for the user's contacting skin or hair.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A strap cover comprising a tubular sleeve formed of a laminated bilayer material having an elastomeric inner layer and a non-abrasive outer layer, said laminated bilayer material affixed along opposite edges to form said laminated bilayer material into a tubular sleeve having a longitudinal seam formed by said affixed opposite edges, said opposite edges being removably affixed, and further comprising a pocket accessible through an aperture in an exterior surface of said pocket.

2. The strap cover according to claim 1, wherein said outer layer is formed of a soft pile fabric.

3. The strap cover according to claim 1, further comprising fastening material for removably affixing said opposite edges together.

4. The strap cover according to claim 3, wherein said fastening material comprises hook and loop fasteners.

5. The strap cover according to claim 1, further comprising an insert sized to fit within said pocket.

6. The strap cover according to claim 5, wherein said insert comprises a cushion.

7. The strap cover according to claim 5, wherein said insert comprises a dispensing pad.

8. The strap cover according to claim 7, further comprising a treatment material selected from conditioner and petroleum gel.

9. The strap cover according to claim 1, further comprising a chin strap enwrapped by said strap cover.

* * * * *